US005711235A

United States Patent [19]

May et al.

[11] Patent Number: 5,711,235

[45] Date of Patent: Jan. 27, 1998

[54] WASTE CONVEYOR AND METHOD FOR INSPECTING THE CONTENTS OF A CONVEYOR CHANNEL FOR WASTE

[75] Inventors: Karl May, Bad Vilbel; Hartmut Herm, Dreieich; Karlheinz Unverzagt, Seligenstadt, all of Germany

[73] Assignee: Siemens Aktiengesellschaft, Munich, Germany

[21] Appl. No.: 603,937

[22] Filed: Feb. 20, 1996

Related U.S. Application Data

[63] Continuation of PCT/DE94/00904, Aug. 4, 1994, published as WO95/05430, Feb. 23, 1995.

[30] Foreign Application Priority Data

Aug. 17, 1993 [DE] Germany ..... 43 27 633.4

[51] Int. Cl.[6] ..... F23G 5/00

[52] U.S. Cl. ..... 110/257; 110/255; 110/346

[58] Field of Search ..... 110/255, 257, 110/346; 209/705, 913; 431/154, 155

[56] References Cited

U.S. PATENT DOCUMENTS

| | | | |
|---|---|---|---|
| 1,540,662 | 6/1925 | Stone . | |
| 1,566,608 | 12/1925 | Kruse | 110/255 |
| 1,703,418 | 2/1929 | Dwyer . | |
| 4,261,795 | 4/1981 | Reilly | 110/257 |
| 4,301,750 | 11/1981 | Fio Rito . | |
| 5,220,873 | 6/1993 | Milsap, III . | |

FOREIGN PATENT DOCUMENTS

| | | |
|---|---|---|
| 0 302 310 | 2/1989 | European Pat. Off. . |
| 38 30 153 | 3/1990 | Germany . |
| 1 394 039 | 5/1975 | United Kingdom . |

*Primary Examiner*—Ira S. Lazarus
*Assistant Examiner*—Nhat-Hang H. Lam
*Attorney, Agent, or Firm*—Herbert L. Lerner; Laurence A. Greenberg

[57] ABSTRACT

A conveyor for waste has a waste feed shaft which is laterally connected to a horizontally divided conveyor channel. A screw conveyor being drivable by a motor is located in the longitudinal direction of the conveyor channel. The conveyor channel opens into a housing, in particular into a pyrolysis reactor, which by way of example is operated in conjunction with a low-temperature carbonization combustion process. In order to easily eliminate blockages of the screw conveyor, a unit formed of the screw conveyor and the conveyor channel is disconnectably secured to the housing and is removable from the housing through the use of a traveling mounting. A method for inspecting the contents of a conveyor channel receiving waste and discharging into a housing, especially a pyrolysis reactor, includes disconnecting the conveyor channel from the housing, driving the conveyor channel away with a traveling mounting, and opening the conveyor channel.

11 Claims, 2 Drawing Sheets

WASTE CONVEYOR AND METHOD FOR INSPECTING THE CONTENTS OF A CONVEYOR CHANNEL FOR WASTE

CROSS-REFERENCE TO RELATED APPLICATION

This application is a Continuation of International Application Serial No. PCT/DE94/00904, filed Aug. 4, 1994, published as WO95/05430 Feb. 23, 1995.

BACKGROUND OF THE INVENTION

Field of the Invention

The invention relates to a conveyor for waste, in which a waste feed shaft is connected to a conveyor channel, in the longitudinal direction of which a screw conveyor being drivable by a motor is disposed, and in which the conveyor channel opens into a housing, in particular into a pyrolysis reactor. The invention also relates to a method for inspecting the contents of a conveyor channel for waste, wherein the conveyor channel opens into a housing, in particular into a pyrolysis reactor. The rubbish or waste conveyor is used for thermal waste disposal, especially by the low-temperature carbonization combustion process.

In the field of waste disposal, the so-called low-temperature carbonization combustion process has become known. The process for thermal waste disposal and a system operating according to that process are described, for instance, in Published European Patent Application 0 302 310 A1, corresponding to U.S. Pat. No. 4,878,440 as well as in German Published, Non-Prosecuted Patent Application DE 38 30 155 A1. The system for thermal waste disposal according to the low-temperature carbonization combustion process includes a pyrolysis reactor and a high-temperature combustion chamber as its essential components. The pyrolysis reactor converts the waste being fed through a waste conveyor of the type referred to at the outset, into low-temperature carbonization gas and pyrolysis residue. The low-temperature carbonization gas and the pyrolysis residue are then delivered, after suitable preparation, to the burner of the high-temperature combustion chamber. That produces molten slag, which can be removed through an outlet and which is in vitrified form after it cools down. The flue gas being produced is sent through a flue gas line to a chimney serving as an outlet. A waste heat steam generator acting as a cooling device, a dust filter system, and a flue gas cleaning system, in particular, are built into the flue gas line. A gas compressor which is disposed directly at the outlet of the flue gas cleaning system and may be constructed as a suction blower, is also located in the flue gas line. The built-in gas compressor serves to maintain a negative pressure, if only slight, in the pyrolysis drum. That negative pressure prevents low-temperature carbonization gas from escaping to the outside environment through the ring seals of the pyrolysis drum.

It has been found that the waste conveyor can be blocked or impeded in a low-temperature carbonization combustion system if excessively large particles of waste fall from the feed shaft into the coil of the worm. Yet rapid elimination of a blockage of the screw conveyor is necessary for continuous operation, because as a rule new trash or waste is furnished continuously. It is also important that the screw conveyor be capable of being replaced quickly, should that become necessary.

SUMMARY OF THE INVENTION

It is accordingly an object of the invention to provide a waste conveyor and a method for inspecting the contents of a conveyor channel for waste, which overcome the hereinafore-mentioned disadvantages of the heretofore-known devices and methods of this general type, in which the conveyor for waste is constructed in such a way that a blockage can be rapidly overcome and in which the method for inspecting the contents of the conveyor channel for waste that opens into a housing can be performed quickly and easily.

With the foregoing and other objects in view there is provided, in accordance with the invention, a conveyor for waste, comprising a waste feed shaft; a conveyor channel being connected to the waste feed shaft, the conveyor channel having a longitudinal direction and being horizontally divided; a screw conveyor disposed in the longitudinal direction of the conveyor channel; a motor for driving the screw conveyor; a housing, especially a pyrolysis reactor, into which the conveyor channel discharges; the screw conveyor and the conveyor channel forming a unit being readily disconnectably secured to the housing; and a traveling mounting for removing the unit from the housing.

The above-mentioned horizontal divisibility of the conveyor channel is provided in order to assure especially fast elimination of blockages and/or rapid replacement of the screw conveyor. In the removed state, one part of the conveyor channel can be disconnected from the other part, for example at screw connections, so that the interior and therefore the screw conveyor are easily accessible. Waste particles that have caused jamming of the screw conveyor, for instance, can then easily be removed. The transport conveyor can then be closed again and returned to its position in the housing through the use of the traveling mounting.

If the unit including the screw conveyor and the conveyor channel is removed from the housing, particularly from a pyrolysis reactor, through the use of this traveling mounting, then the screw conveyor is easily accessible, so that any malfunction at that location can be rapidly eliminated. Optionally, the screw conveyor is also easy to remove, so that rapid replacement is assured. This is important particularly for repair work on the screw conveyor, or for maintenance work.

In accordance with another feature of the invention, a kind of car or carriage which is movable on at least one rail is used as the traveling mounting.

In accordance with a further feature of the invention, the motion of the traveling mounting may be executed by hand but preferably by machine.

In accordance with an added feature of the invention, the traveling mounting is horizontally movable.

In accordance with an additional feature of the invention, the traveling mounting has at least three and preferably four wheels.

In accordance with yet another feature of the invention, the conveyor channel is a screw conveyor trough, the screw conveyor is disposed in the conveyor channel, and there is provided a seal securing the conveyor channel to the housing.

In accordance with yet a further feature of the invention, there is provided a connection disconnectably securing the waste feed shaft to the conveyor channel.

With the objects of the invention in view, there is also provided a method for inspecting the contents of a conveyor channel receiving waste and discharging into a housing, preferably a pyrolysis reactor, which comprises disconnecting the conveyor channel from the housing; driving the conveyor channel away with a traveling mounting; and opening the conveyor channel.

Other features which are considered as characteristic for the invention are set forth in the appended claims.

Although the invention is illustrated and described herein as embodied in a waste conveyor and a method for inspecting the contents of a conveyor channel for waste, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
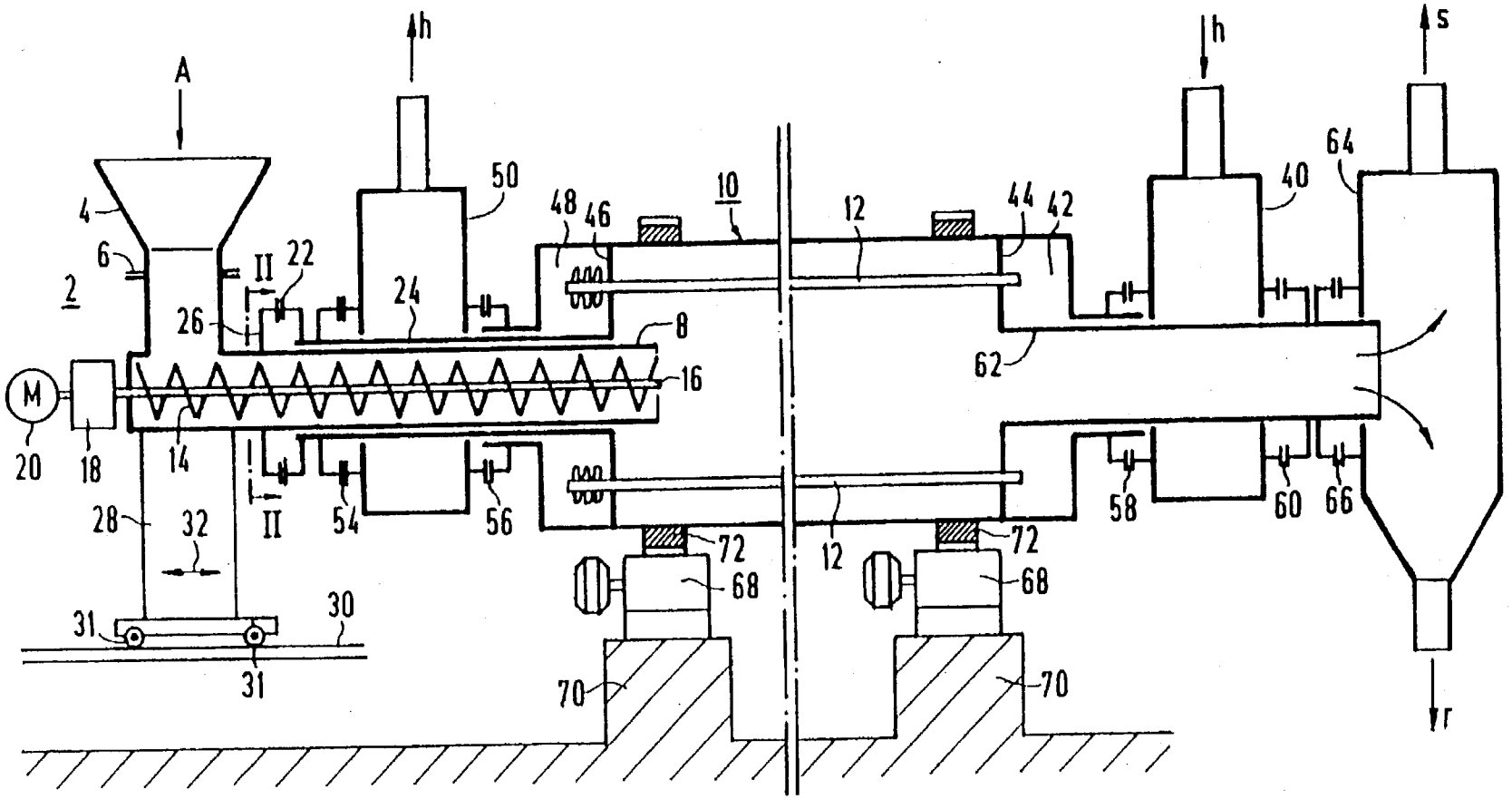
FIG. 1 is a diagrammatic, longitudinal-sectional view of a conveyor for waste, as part of a low-temperature carbonization combustion system.

Referring now to the figures of the drawing in detail and first, particularly, to FIG. 1 thereof, there is seen a conveyor 2 for waste or rubbish A, in which a waste feed shaft 4 is connected to a conveyor channel 8 through a disconnectable fastening device 6. The conveyor channel 8 in this case is constructed as a worm or screw conveyor trough. The conveyor channel 8 may have a round cross section but preferably has a polygonal cross section. The conveyor channel 8 opens into a housing 10 and in the present case into a pyrolysis reactor. The pyrolysis reactor is a low-temperature carbonization drum that rotates about its longitudinal axis and is equipped with a relatively large number of heating tubes 12 disposed parallel to the longitudinal axis.

A worm or screw conveyor 14 is disposed and extends longitudinally in the interior of the conveyor channel 8, which is stationary during normal operation. A shaft 16 of the screw conveyor 14 is driven by a motor 20 through a gear 18. The waste feed shaft 4 is disposed laterally of the conveyor channel 8, on its end.

An important feature is that the unit including the screw conveyor 14 and the conveyor channel 8 is disconnectably secured to the housing or drum 10. This is accomplished by closable ring seals 22, which are secured on one hand to the left-hand end of a feed tube 24 that surrounds the conveyor channel 8 and on the other hand to a flange 26 on the conveyor channel 8. Another significant factor is that the unit including the screw conveyor 14 and the conveyor channel 8 is supported on a trolley or a traveling mounting 28. This relatively heavy unit having the elements 14, 8 also includes the gear 18 and the motor 20. The traveling mounting 28 is a kind of car or carriage that is horizontally movable on rails 30. Two or more rails 30 may be provided. The traveling mounting 28 has at least three and preferably four wheels 31. Horizontal mobility is represented by a double-headed arrow 32. The traveling mounting 28 may be moved by hand through the use of an auxiliary device but preferably through the use of a non-illustrated machine.

Once the connecting points at the fastening device 6 and the ring seals 22 have been undone, the aforementioned unit 14, 8, 18, 20 can thus be removed from the housing or drum 10. In the removed position, the conveyor channel 8 along with the conveyor screw or worm 14 can be relatively easily inspected and cleaned. Blockages can thus be eliminated. In the removed state an easy replacement of the screw conveyor 14 is also possible. However, it is important that blocking waste particles can be rapidly removed from the conveyor screw 14.

The individual method steps are thus as follows:

1. shut off rotary motion of the housing or drum 10;
2. disconnect the closable ring or worm seal 22 and the fastening device or connection 6;
3. move the screw conveyor 14 together with the conveyor channel 8 out of the feed tube 24;
4. open the conveyor channel 8, especially in accordance with FIG. 2 in a manner to be discussed below;
5. remove any blockage in the form of a large particle;
6. close the conveyor channel 8;
7. drive the screw conveyor 14 together with the conveyor channel 8 back again; and
8. re-secure the closable ring or worm seal 22 and the fastening device or connection 6.

In FIG. 1, the waste A is heated indirectly in the housing or rotating low-temperature carbonization drum 10 by heating gas h through the use of the heating tubes 12. This heating gas h is carried through a stationary heating gas inlet housing 40 into a hot heating gas chamber 42 in the interior of the low-temperature carbonization drum 10. The parallel-extending heating tubes 12 are secured at one end to a tube bottom wall 44 of the drum 10. The heating tubes 12 are secured at another end in a tube bottom wall 46 that forms one wall of a cold heating gas chamber 48. The heating gas h passes from this cold heating gas chamber 48 through a heating gas outlet housing 50 into an outlet. In order to seal off the heating gas outlet housing 50 from the rotating tube, ring seals 54, 56 are provided. In order to seal off the heating gas inlet housing 40, ring seals 58, 60 are correspondingly provided. A discharge tube 62 is extended from the interior of the low-temperature carbonization drum 10, or more specifically from the tube bottom 44, into the interior of a stationary discharge device 64. The low-temperature carbonization material that reaches this discharge device 64 through the discharge tube 62 is divided in this case into low-temperature carbonization gas s and residue r. The residue r can be split apart into various fractions in the low-temperature carbonization combustion process by using a suitable non-illustrated device and can be segregated before being taken for combustion in a non-illustrated high-temperature combustion chamber. In order to decouple the discharge device 64 from the rotation of the low-temperature carbonization drum 10, a disconnectable ring seal 66 is disposed on the discharge device 64.

The rotation of the low-temperature carbonization drum 10 about its longitudinal axis is effected by motor drives 68 on bearing rolls that are disposed on bases 70. The drives 68 run on races 72 that are disposed on the periphery of the low-temperature carbonization drum 10.

Figure 2:
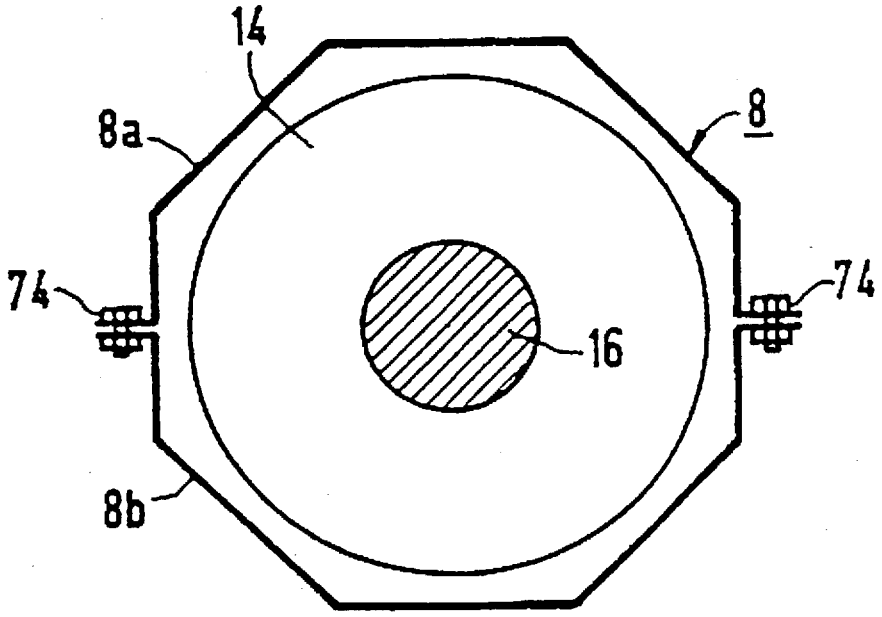
FIG. 2 is a cross-sectional view taken in the direction of a line II—II of FIG. 1, in the direction of the arrows along a screw conveyor.

It becomes clear from the sectional view of FIG. 2 that the conveyor channel 8 is preferably constructed to be n-sided, where n is a number greater than 4. In the present example, an octagonal version has been chosen. The screw conveyor accommodated in the conveyor channel 8 is again indicated by reference numeral 14. It also becomes clear from FIG. 2 that the conveyor channel 8 is formed of respective upper and lower shell parts 8*a* and 8*b*. Thus the conveyor channel 8 is constructed to be horizontally divided. The two shell parts 8*a*, 8*b* are held together by screw fastenings 74, which are mounted on longitudinal flanges. These screw fastenings or connections 74 are easily undone as needed. Then the upper shell part 8*a* can easily be raised and the interior inspected.

We claim:

1. A conveyor for waste, comprising:

a waste feed shaft;

a conveyor channel being connected to said waste feed shaft, said conveyor channel having an interior, a longitudinal direction and being formed of an upper shell part and a lower shell part, said upper shell part being releasably connected to said lower shell for allowing access to said interior of said conveyor channel;

a screw conveyor disposed in said interior of said conveyor channel and extending in the longitudinal direction of said conveyor channel;

a motor connected to and driving said screw conveyor;

a housing into which said conveyor channel discharges;

said screw conveyor and said conveyor channel forming a unit being disconnectably secured to said housing for engaging and disengaging said housing; and a traveling mounting supporting said unit and said traveling mounting assisting in removal of said unit from said housing.

2. The conveyor according to claim 1, wherein said housing is a pyrolysis reactor.

3. The conveyor according to claim 1, including at least one rail, said traveling mounting being a carriage movable on said at least one rail.

4. The conveyor according to claim 1, wherein said traveling mounting is manually movable.

5. The conveyor according to claim 1, wherein said traveling mounting is movable by machine.

6. The conveyor according to claim 1, wherein said traveling mounting is horizontally movable.

7. The conveyor according to claim 1, wherein said traveling mounting has at least three wheels.

8. The conveyor according to claim 1, wherein said conveyor channel is a screw conveyor trough, said screw conveyor is disposed in said conveyor channel, and including a seal securing said conveyor channel to said housing.

9. The conveyor according to claim 8, including a connection disconnectably securing said waste feed shaft to said conveyor channel.

10. A method for inspecting the contents of a conveyor channel receiving waste and discharging into a housing, which comprises:

a) disconnecting the conveyor channel from the housing;

b) driving the conveyor channel away with a traveling mounting; and b) opening the conveyor channel.

11. The method according to claim 10, which comprises disconnecting the conveyor channel from a pyrolysis reactor forming the housing.

* * * * *